United States Patent [19]

Ishii

[11] 4,306,227

[45] Dec. 15, 1981

[54] MOTOR ACTUATED BELL

[75] Inventor: Tadashi Ishii, Kunitachi, Japan

[73] Assignee: Kobishi Electric Co., Ltd., Tokyo, Japan

[21] Appl. No.: 168,423

[22] Filed: Jul. 10, 1980

[30] Foreign Application Priority Data

Jul. 3, 1980 [JP] Japan ..... 55-93987[U]

[51] Int. Cl.[3] ..... G10K 1/064

[52] U.S. Cl. ..... 340/396; 340/392; 340/402

[58] Field of Search ..... 340/392, 396, 402; 116/148, 152, 154, 155

[56] References Cited

U.S. PATENT DOCUMENTS 4,183,018 1/1980 Sakaguchi ..... 340/396

*Primary Examiner*—Harold I. Pitts

*Attorney, Agent, or Firm*—Darby & Darby

[57] ABSTRACT

A motor actuated bell comprising a motor having a drive shaft; transmission means for transmitting the rotational movement of the shaft to a second supporting shaft; a cam member which is fixedly mounted on the second supporting shaft; at least two hammer driving means disposed to be capable of moving reciprocally back and forth in relation to the gong and arranged respectively in continuous contact with the cam surface by a biased force of each first resilient means which is provided to said respective hammer driving means; and a hammer connected to each hammer driving means through a second resilient means so as to transmit the reciprocal movement of said hammer driving means to the hammer thereby striking the gong with the hammer. The motor actuated bell may preferably be used in a fire bell, an alarm bell or the like.

4 Claims, 3 Drawing Figures

MOTOR ACTUATED BELL

BACKGROUND OF THE INVENTION

The present invention generally relates to motor actuated bells and, more particularly though not exclusively to motor actuated bells such as may be employed in a fire bell, an alarm bell or the like.

A typical arrangement of a conventional motor actuated bell as shown in FIG. 1, where a gong is omitted to illustrate briefly the mechanism of the bell, comprises: a motor 100 having a motor shaft 101, on which a worm gear 102 is fixedly mounted; a convertion means composed of a worm wheel 103 and a cam 105 both of which fixedly mounted on a drive shaft 104, the worm wheel 103 being mated with the worm gear 102 to transmit the rotational movement of the motor shaft 101 to the drive shaft 104 in a reduced speed; and a hammer 106 one end of which serves as a cam follower in contact with the surface of the cam 105, the other end of which strikes against an associated gong (not shown) resisting against the bias strength of a coil spring 107 to generate bell sounds.

A motor actuated bell thus constructed operates in such a manner as the motor 100 is driven to rotate the cam 105 through the meshed gears 102 and 103, and the cam 105, in turn, intermittently acts on the one end of the hammer 106 to allow the other end thereof strike against the gong. The power required to operate such a motor actuated bell is relatively large due to the need for substantial torque to enable the hammer to generate a sufficiently large sound volume, when compared with a conventional electromagnetic bell and for this reason bells of this kind are not suitable for practical use.

SUMMARY OF THE INVENTION

It is, therefore, a principal object of the present invention to provide a motor actuated bell of the type which is capable of generating a bell sound of substantially large volume without the need for a greater motor torque.

Briefly, a motor actuated bell according to the invention is constructed in such a way as it can be operated under a relatively small motor torque by employing two hammers which are actuated by means of a single cam.

According to a broad aspect of the invention there is provided a motor actuated bell which comprises: a gong; an electric motor having a drive shaft; transmission means for transmitting the rotational movement of said shaft to a second supporting shaft; a cam member which is fixedly mounted on the second supporting shaft; at least two hammer driving means disposed to be capable of moving reciprocally back and forth in relation to the gong and arranged respectively in contact with the cam surface by a biased force of each first resilient means which is provided to said respective hammer driving means; and a hammer connected to each hammer driving means by means of a second resilient means so as to transmit the reciprocal movement of said hammer driving means to the hammer thereby striking the gong with the hammer. Preferably, the transmission means comprises a worm gear fixedly mounted on the drive shaft, and a worm wheel fixedly mounted on the second supporting shaft to mate with the worm gear.

The foregoing and other objects, features and advantages of the present invention will become manifest to those versed in the art upon making reference to the detailed description and the accompanying sheets of drawings in which a preferred embodiment incorporating the principles of the present invention is shown by way of an illustrative example.

DESCRIPTION OF THE PREFERRED EMBODIMENT

Figure 1:
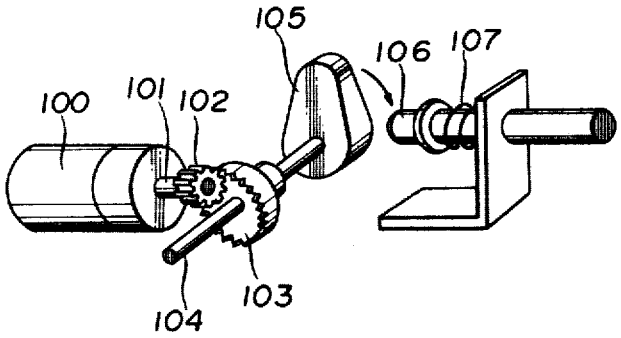
Fig. 1 (Prior Art)
FIG. 1 is a schematic perspective view of a motor actuated bell constructed in accordance with the prior art.
Figure 2:
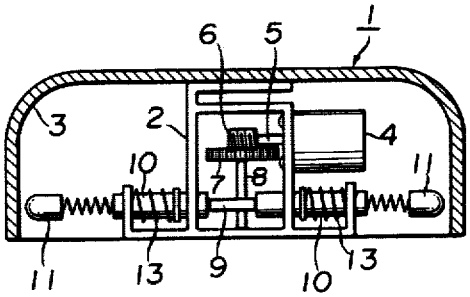
FIG. 2 is a cross-sectional view of a motor actuated bell according to an embodiment of this invention.
Figure 3:
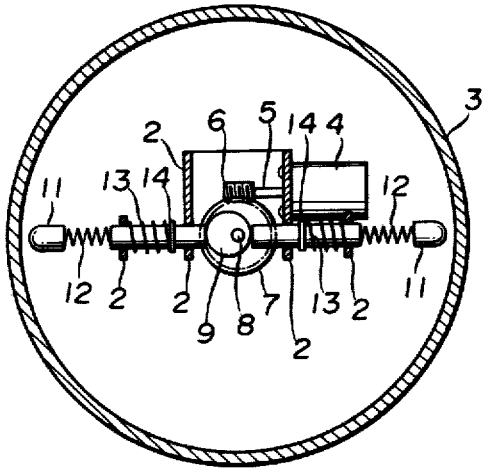
FIG. 3 is a bottom plan view of the bell as shown in FIG. 2.

FIGS. 2 and 3 show a motor actuated bell 1 constructed in accordance with an embodiment of the invention. A mounting plate 2 fixed to the central portion of the inner wall of a gong 3 with an appropriate fixing means such as a bolt or nut is formed of such a shape as it accomodates each mechanical element which constitutes the motor actuated bell 1. The gong 3 is made of iron in the form of a cup or a semisphere. An electric motor 4 is fixedly mounted on the mounting plate 2 by screws, the motor 4 having a shaft 5 capable of continuous rotation in accordance with its drive current. A worm gear 6 is fixedly mounted on the drive shaft 5 for rotation therewith and is operatively mated with a worm wheel 7 which is fixedly mounted on a supporting shaft 8 at one end thereof, the supporting shaft 8 being supported on the mounting plate 2 in rotational relation therewith. Adjacent to the other end of the supporting shaft 8, there is provided an eccentric cam 9 which is fixedly secured to the supporting shaft 8 for rotation thereabout, the eccentric cam 9 being arranged to contact with two hammer driving members 10, 10 at an arcuate surface of the cam 9 which is capable of serving as a cam surface.

The two hammer driving members 10, 10 are respectively supported through each two bores formed in the mounting plate 2, which enables the hammer driving members 10, 10 to move reciprocally in relation with the inner surface of the gong 3.

As a result, two hammers 11, 11, each respectively connected at the end of the two hammer driving members 10, 10 by means of resilient members 12, 12 such as springs, are capable of striking the gong surface to generate a bell sound in accordance with the movement of the cam 9 surface which urges to push the hammer driving members 10, 10 back and forth relative to the gong surface. It should be noted that there is provided other resilient members 13, 13 which are respectively connected at one end thereof to collar rings 14, 14 secured around the hammer driving members 10, 10, and are respectively disposed to abut freely against the walls of the mounting plate 2 at the other end of the resilient members 13, 13. The resilient members 13, 13 such as springs act on the hammer driving members 10, 10 to impart resilient force thereto through the collar rings 14, 14 so that, when the hammer driving members 10, 10 are expelled in a forward direction relative to the gong surface, the hammer driving members 10, 10 are subjected to a reverse-force exerted from the resilient members 13, 13 in a backward direction relative to the gong surface thereby maintaining the hammer driving members 10, 10 to abut continuously against the cam 9 surface during its operation.

The operation of the motor actuated bell thus constructed will be described.

Upon energization of the electric motor 4, its rotary shaft 5 is rotated so that the worm gear 6 is urged to rotate around the shaft 5. The worm gear 6 which is operatively mated with the worm wheel 7, in turn, urges to rotate the worm wheel 7 thereby causing the supporting shaft 8 to rotate around itself. As a result, the eccentric cam 9 rotates in contact relation with the both hammer driving members 10, 10. As the eccentric cam 9 is formed in offset relation with the cam center, the rotation of the cam 9 gives reciprocal movement to the hammer driving members where the cam 9 and the hammer driving members 10, 10 are continuously maitained in contact with each other. Each time the hammer driving member 10 is expelled toward the gong 3 as is shown in FIG. 3 at the left side thereof, the hammer 11 at the left strikes the gong 3, while the hammer 11 at the right is kept apart from the gong 3 surface. The number of gong striking is accordingly two times that of the rotation of the cam 9 about the shaft. Thus, the motor actuated bell according to the invention enjoys a relatively large bell sound with a low driving power due to the construction in which a driving torque exerted from the cam is smoothly and continuously imparted to both the hammer driving members 10 and 10.

As is described above, it is a feature of the invention to provide a motor actuated bell in which driving power for a hammer to strike a gong is supplied smoothly and continuously from a motor by a cam and two cam followers, i.e., hammer driving members.

Having described our invention as related to the embodiment shown in the accompanying drawings, it is our intention that the invention is not limited by any of the details of description, unless otherwise specified, but rather is construed broadly within its spirit and scope as set out in the accompanying claims.

What is claimed is

1. A motor actuated bell which comprises:

a gong;

an electric motor having a drive shaft;

transmission means for transmitting the rotational movement of said shaft to a second supporting shaft;

a cam member which is fixedly mounted on the second supporting shaft;

at least two hammer driving means disposed to be capable of moving reciprocally back and force in relation to the gong and arranged respectively in continuous contact with the cam surface by a biased force of each first resilient means which is provided to said respective hammer driving means; and a hammer connected to each hammer driving means by means of a second resilient means so as to transmit the reciprocal movement of said hammer driving means to the hammer thereby striking the gong with the hammer.

2. A motor actuated bell according to claim 1, in which said transmission means comprises a worm gear fixedly mounted on the drive shaft, and a worm wheel fixedly mounted on the second supporting shaft to mate with the worm gear.

3. A motor actuated bell according to claim 1, in which said cam member is an eccentric cam whose arcuate surface contacts continuously with the ends of the hammer driving means.

4. A motor actuated bell according to claim 1, in which said first and second resilient means are springs.

* * * * *